US005328422A

United States Patent [19]

Nichols

[11] Patent Number: 5,328,422

[45] Date of Patent: Jul. 12, 1994

[54] LADDER-CLIMBING EXERCISE DEVICE

[76] Inventor: Steven M. Nichols, 6664 Boston State Rd., Hamburg, N.Y. 14075

[21] Appl. No.: 100,628

[22] Filed: Jul. 30, 1993

[51] Int. Cl.[5] ..... A63B 23/06

[52] U.S. Cl. ..... 482/52; 482/37; 482/51; 482/54; 482/111

[58] Field of Search ..... 482/52, 53, 54, 111, 482/112, 37, 51, 3-7

[56] References Cited

U.S. PATENT DOCUMENTS

| | | | |
|---|---|---|---|
| 4,923,191 | 5/1990 | Persico | 482/52 |
| 4,927,136 | 5/1990 | Leask | 482/52 |
| 5,102,380 | 4/1992 | Jacobson et al. | 482/54 |

FOREIGN PATENT DOCUMENTS

| | | | |
|---|---|---|---|
| 1057928 | 5/1959 | Fed. Rep. of Germany | 482/54 |
| 1565617 | 3/1969 | France | 482/54 |
| 0560622 | 7/1977 | U.S.S.R. | 482/54 |
| 2184361 | 6/1987 | United Kingdom | 482/54 |

*Primary Examiner*—Stephen R. Crow

*Attorney, Agent, or Firm*—Sommer, Oliverio & Sommer

[57] ABSTRACT

A ladder-climbing exercise device (10) includes an inclined flight (13) along which a plurality of rungs (29) are presented in an endless manner. The marginal ends of the rungs are mounted on endless chains which are supported by a frame. The chains are coupled to a fan (43) having a squirrel cage-like rotor. The position of an operator (P) relative to the flight changes the size of a fan aperture (45) to vary the resistance afforded by the device to the climbing motion.

10 Claims, 3 Drawing Sheets

Fig. 5.
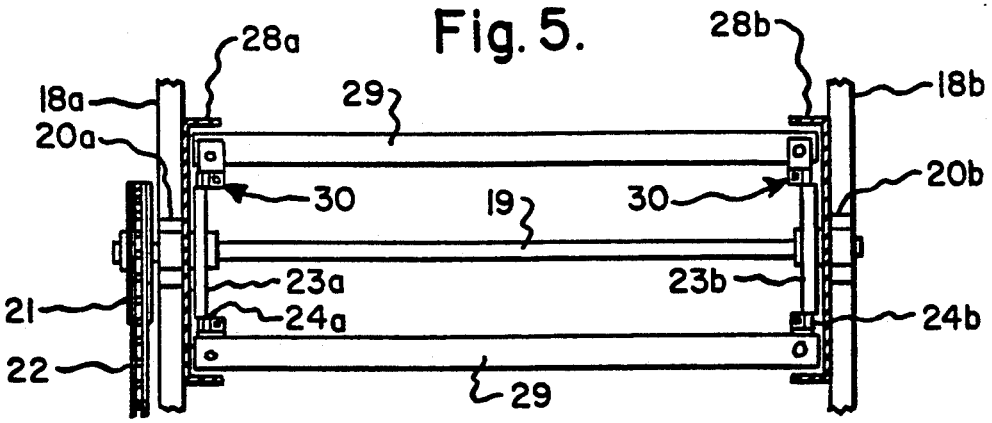
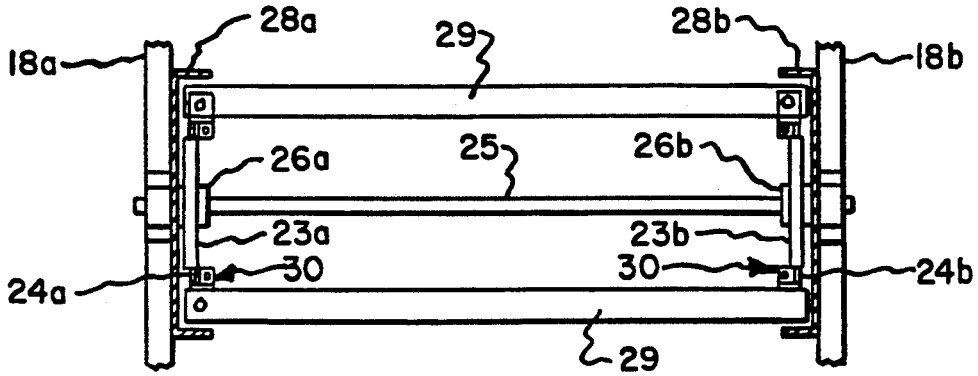
Fig. 6.
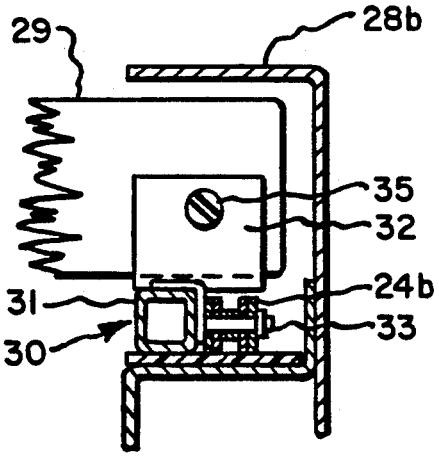
Fig. 7.
Fig. 8.
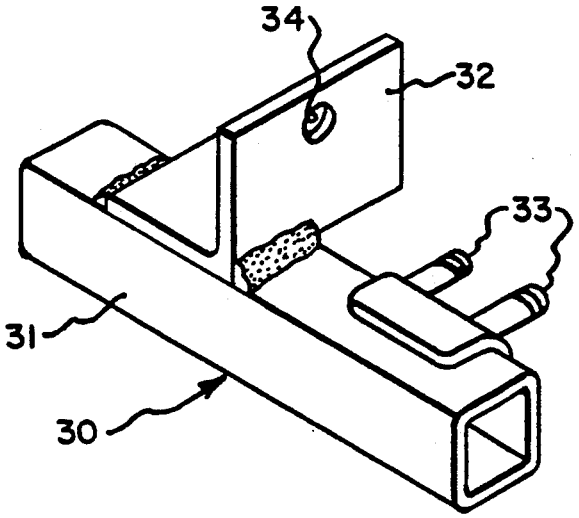

LADDER-CLIMBING EXERCISE DEVICE

TECHNICAL FIELD

The present invention relates generally to the field of exercise devices, and, more particularly, to an improved exercise device which is adapted to simulate the motion of climbing a ladder and which affords a person the option of varying the pace or speed of such climbing motion as a function of such person's position relative to a flight of endlessly-presented moving rungs.

BACKGROUND ART

Numerous types of exercise devices have, of course, been heretofore developed.

Some of these simulate the action of climbing a ladder. This type of apparatus is representatively shown and described in U.S. Pat. Nos. 4,822,029 and 5,112,043. In both of these devices, a plurality of rungs are mounted on a transversely-spaced pair of endless oval chains. Thus, as the operator attempts to climb an inclined flight, the rungs are presented to him in the form of an endless series. Moreover, both of these patents disclose means for varying the resistance to the climbing motion. For example, in U.S. Pat. No. 4,822,029, the resistance is varied as a function of the tightness of a belt around a brake wheel, somewhat analogous to the resistance afforded by a mechanical dynometer. In U.S. Pat. No. 5,112,043, the resistance to the climbing motion is provided hydraulically.

Other types of exercise devices restrict the flow of air to resist the operator's motion. Examples of this type are shown and described in U.S. Pat. Nos. 4,082,264, 4,961,570 and 4,943,049. Other types of exercise devices utilize variant types of fans. These are representatively shown and described in U.S. Pat. Nos. 4,815,951 and 4,537,396.

While these types of devices may have been suitable for their intended uses and purposes, there is believed to be a need to provide an improved exercise device which simulates the motion of climbing a ladder with a simple and alternative means for varying the resistance of the climbing motion. Thus, the amount of energy which a person must expend may be readily varied as a function of his physical ability and conditioning.

DISCLOSURE OF THE INVENTION

With parenthetical reference to the corresponding parts, portions or surfaces of the disclosed embodiment, merely for purposes of illustration and not be way of limitation, the present invention broadly provides an improved exercise device (10) which is adapted to enable a person to simulate the climbing of a ladder by presentment of an endless series of rungs, while the person remains in a non-translational generally constant spatial position. The improved device broadly includes a frame (11); a pair of transversely-spaced endless members (24*a*,24*b*) journalled on the frame, the members having parallel portions along the flight; a plurality of rungs (29) having their opposite marginal end portions secured to the respective endless members at longitudinally-spaced locations therealong; resistance means (43) for providing a variable resistance to free unimpeded movement of the members and rungs; and control means (50) operatively arranged to vary the resistance afforded by the resistance means as a function of the position of the person relative to the flight portions.

In another aspect, the invention provides an improvement in an exercise device (10) adapted to enable a person to simulate the climbing of a ladder. This device has a plurality of rungs (29) adapted to move relative to a person while that person remains generally in the same spatial location, and wherein the device has a moving flight portion (13) upon which the person attempts to climb, and wherein the device has a resistance device (43) adapted to impede the free movement of the rungs along the flight portion. In this form, the improvement comprises: control means (50) for varying the resistance afforded by the resistance device as a function of the position of the person relative to the flight portion; whereby, by varying his position relative to the flight portion, the person may vary the resistance afforded by the exercise device, thereby causing his pace to vary.

In still another aspect, the invention provides a method of operating an exercise device (10) to enable a person to simulate the motion of climbing a ladder by presentment of an endless series of rungs (29), while such person remains in a non-translational spatial location. This method broadly comprises the steps of: providing a frame (11), moving a plurality of spaced rungs (29) in an endless series along the frame along a flight (13); moving along the rungs of the flight to simulate a climbing motion while remaining in substantially the same spatial location; moving along the rungs relative to the frame; and varying the resistance of the moving rungs to the climbing motion as a function of the person's position relative to the frame; thereby to vary the pace or speed of the device to the climbing motion by varying the position of said person relative to said frame.

Accordingly, the general object of the invention is to provide an improved exercise device which is adapted to simulate the motion of climbing a ladder.

Another object is to provide an improved ladder-climbing exercise device which affords the means to the operator to readily change or vary the resistance of the device to the climbing motion.

Still another object is to provide an improved exercise device which simulates the motion of climbing a ladder and in which the resistance to such climbing motion may be readily varied by simply changing the position of a person's body relative to a stationary frame.

These and other objects and advantages will become apparent from the foregoing and ongoing written specification; the drawings, and the appended claims.

BRIEF DESCRIPTION OF THE DRAWINGS

FIG. 5 is a fragmentary transverse sectional view thereof, taken generally on line 5—5 of FIG. 1, showing the sprocket and shaft at the upper end of the flight.

FIG. 6 is a fragmentary transverse sectional view thereof, taken generally on line 6—6 of FIG. 1, showing the idler sprockets at the lower end of the flight.

FIG. 7 is an enlarged fragmentary detailed view of the area indicated by the dotted circle of FIG. 3, showing the manner by which the right end of a rung is secured to the endless chain.

FIG. 8 is a prospective view of the rung- and chain-engaging member shown in FIG. 7.

DESCRIPTION OF THE PREFERRED EMBODIMENTS

Figure 1:
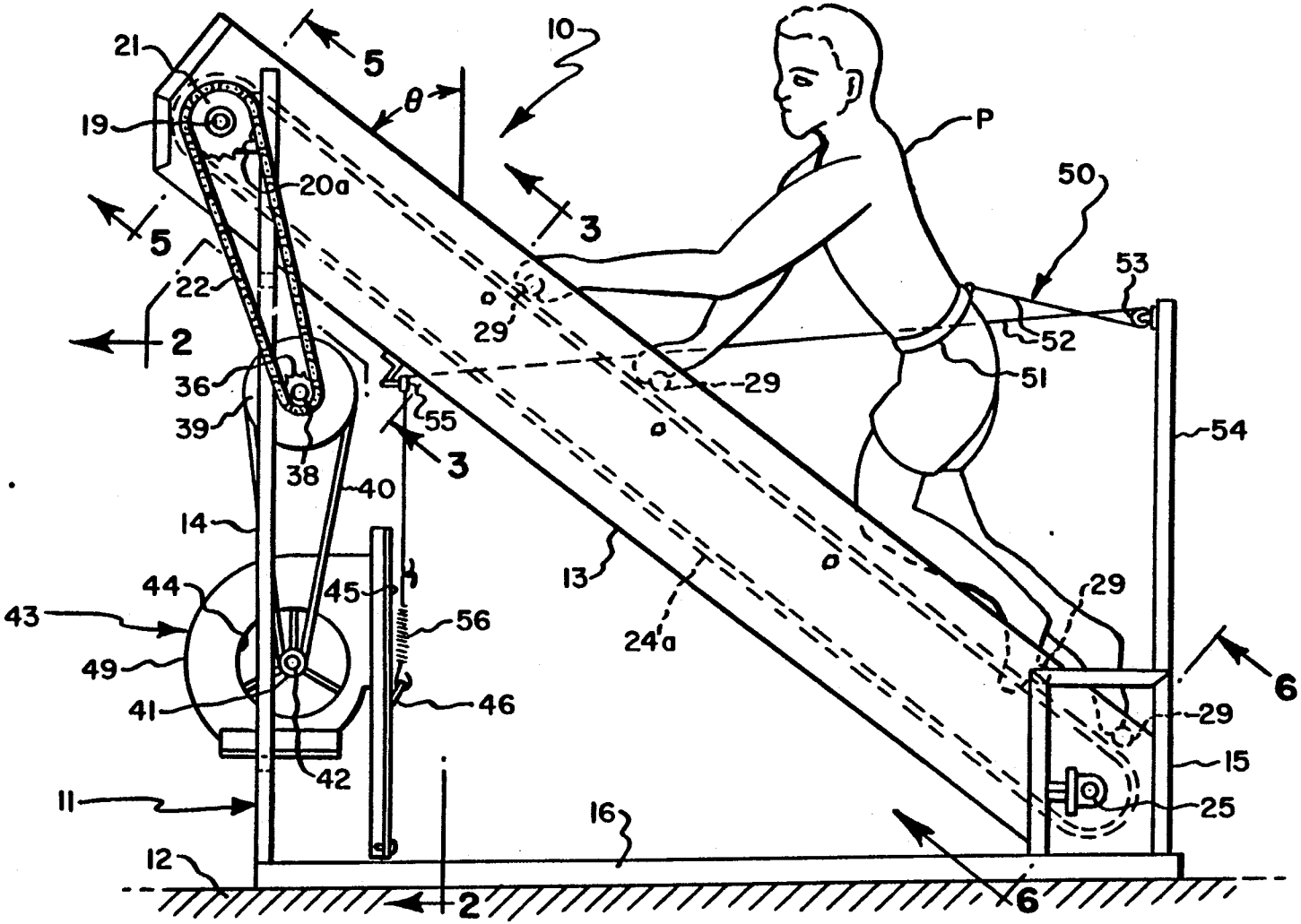
FIG. 1 is a side elevation of the improved ladder-climbing exercise device, showing a person as climbing along the flight and as being connected via the cord to the fan opening.

At the outset, it should be clearly understood that life reference numerals are intended to identify the same structural elements, portions or surfaces consistently throughout the several drawings figures, as such elements, portions of surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Turning now to the drawings, and, more particularly, to FIG. 1 thereof, the improved exercise device is generally indicated at 10. The improved device is shown as having a frame, generally indicated at 11, adapted to rest on a suitable floor or support 12. In FIG. 1, the frame is depicted as having an inclined portion forming a flight 13. The left or upper end of this flight is supported by a pair of transversely-spaced vertical legs, severally indicated at 14. The right or lower end of the flight is similarly supported by a plurality of upstanding legs, severally indicated at 15. Legs 14 and 15 both extend upwardly from a suitable base or support 16 which is adapted to rest on floor 12.

As best shown in FIGS. 3 and 5-7, the flight is shown as including laterally-spaced beam-like supports 18*a*,18*b*. At the upper end of the flight, a shaft 19 extends between the supports and is journalled thereon by means of bearings 20*a*, 20*b*. A marginal end portion of shaft 19 extends laterally beyond left beam 20*a*. A toothed socket 21 is mounted on this left marginal end portion, and is adapted to be engaged by a suitable endless chain 22. Left and right wheels or pulleys 23*a*,23*b* are mounted on shaft 19 just inside of beams 18*a*,18*b*, respectively. These may be in the form of toothed sprockets. Two oval-shaped endless flexible chains, indicated at 24*a*,24*b*, respectively, are mounted so as to engage sprockets 23*a*,23*b*, respectively.

At its lower end, the flight is provided with another shaft 25, the marginal end portions of which are journalled in bearings 26*a*,26*b*, provided in beams 18*a*,18*b*, respectively. However, while this lower structure has toothed sprockets 23*a*,23*b*, as at the upper end, toothed drive sprocket 21 has been eliminated. Thus, at its lower end, the direction-changing, sprockets are freely rotatable. The flight is further shown as including inwardly-facing channel-shaped members 28*a*,28*b*, mounted on beams 18*a*,18*b*, respectively so as to protectively encompass the outer ends of the rungs, as well as the chains and the sprockets. The ascending and descending rungs are separated by a planar sheet 27 attached to beams 18*a*,18*b*.

A plurality of rungs, severally indicated at 29, have their left and right marginal end portions suitable connected to the chain via members 30, one of which is shown in FIG. 8. Each of these rung- and chain-engaging members 30 is shown as having a square tubular portion 31, an L-shaped flange bracket 32 welded thereon, and a pair of pins, severally indicated at 33 extending outwardly therefrom to portion 31 to engage the appropriate chain. A hole 34 is provided through the upstanding flange portion of member 32 to receive and accommodate a fastener, such as a screw 35 (FIG. 7), by means of which the flange may be secured to a rung. Thus, the frame includes a stationary flight portion, which is inclined at an angle $\theta$ with respect to the vertical of from 30°-60°, the embodiment shown being at an angle of approximately 50°. Within this flight, a pair of endless chains are mounted on upper and lower sprockets, and present to the an operator an endless series of rungs. Thus, the person may exercise by attempting to climb the rungs. If his motion is timed to the movement of the rungs themselves, the operator may then remain in substantially the same spacial position relative to the frame, while simulating the motion of moving relative to the rungs. As persons skilled in this art will readily appreciate, movement of the rungs relative to the person is equivalent to movement of the person relative to the rungs.

Figure 2:
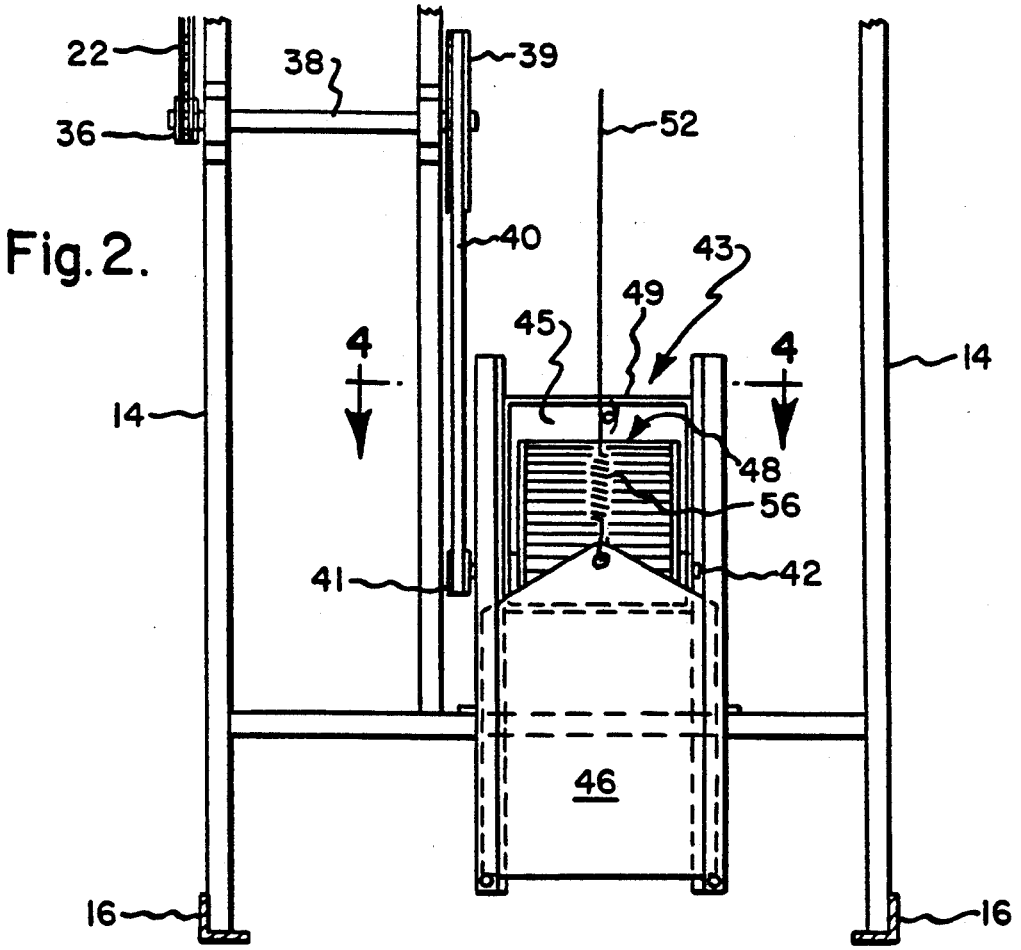
FIG. 2 is a fragmentary vertical sectional view thereof, taken generally on line 2—2 of FIG. 1, showing the variable fan opening in elevation.
Figure 3:
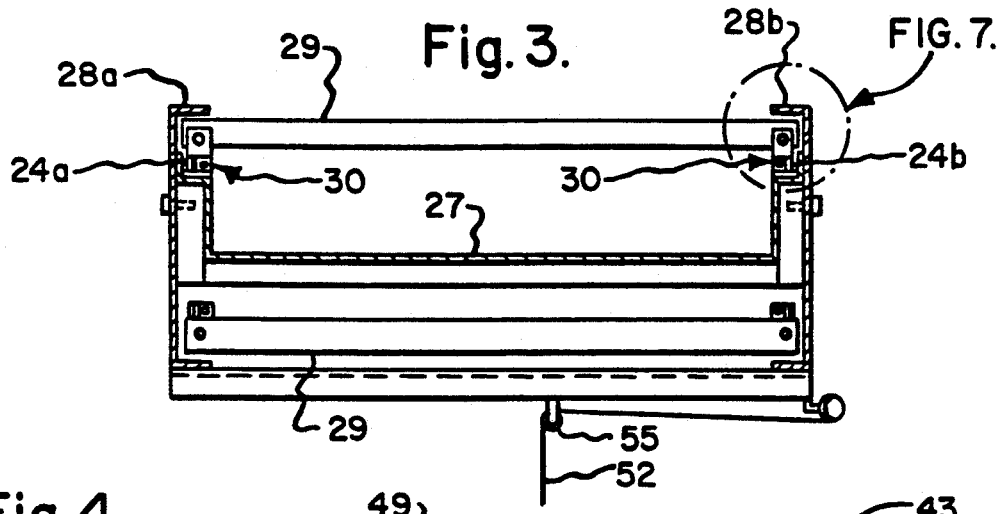
FIG. 3 is a fragmentary transverse sectional view, taken generally on line 3—3 of FIG. 1, showing the flight in transverse cross-section.
Figure 4:
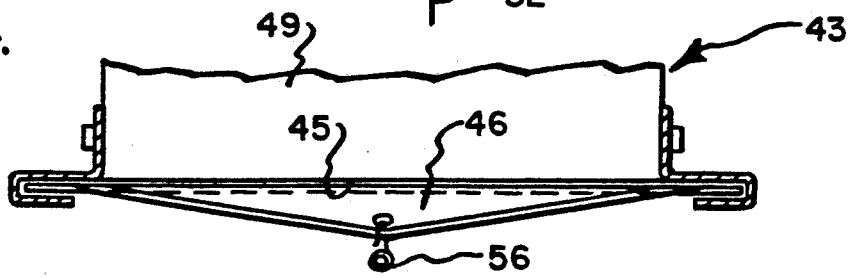
FIG. 4 is a fragmentary horizontal sectional view thereof, taken generally on line 4—4 of FIG. 3, showing the slidable fan opening.

Adverting now to FIGS. 1 and 2, endless chain 22 also passes around a sprocket 36 connected to a shaft 38 upon which a pulley 39 is fixed. A belt 40 connects pulley 39 to a pulley 41 mounted on a shaft 42 of a squirrel cage-type fan, generally indicated at 43. Fan 43 has a downwardly-facing inlet opening 44, and a rightwardly-facing outlet opening 45 which is arranged to be selectively closed by means of a slidable plate 46. A squirrel cage-like rotor, generally indicated at 48 is arranged to rotate within outer fan housing 49 about the axis of shaft 42. Thus, by selectively covering or uncovering outlet opening 45, the flow of air through the fan may be regulated. As the outlet opening is constricted, the resistance afforded by fan 43 will change for a constant rotation of shaft 42.

Adverting now to FIG. 1, the exercise device is shown as further including control means 50, which is adapted to vary the position of plate 46 as a function of the operator's position relative to the inclined flight. In the preferred embodiment, this control means may simply include a belt 51 worn by the operator P. A cord 52 connected to the belt passes around a pulley 53 mounted on the upper marginal end portion of a post 54, and passes around another pulley 55 and has its other marginal end portion connected via a spring 56 to outlet door closure 46. Thus, the operator is physically coupled to the fan closure door, and hence to the resistance to free or impeded motion of the rungs.

Assume that the operator in FIG. 1 is attempting to climb the ladder in a steady-state manner. In other words, assuming that the rungs are being presented to him along the endless chains at a substantially constant velocity. As long as his climbing motion is equals to the speed at which the rungs are presented to him, the operator will remain spatially in the same spatial location, although the rungs are moving relative to him. If the operator now increases his exertion and attempts to move up the flight, the control means will partially close the fan outlet opening, thereby decreasing the resistance to free movement of the rungs. Thus, if the operator moves slightly up the ladder, he will have to exert greater energy (i.e., by quickening his pace) to maintain his position on the ladder. Conversely, if the operator moves his body downwardly along the flight, the fan outlet opening will be increased, and he will have to exert less energy to maintain this position.

Therefore, in summary, the invention provides an improved exercise device which will enable a person to simulate the climbing of a ladder by presentment of an endless series of rungs, while remaining in substantially the same spatial position, and with accompanying means for varying the amount of energy needed to permit the rungs to continue to move at the same velocity as a function of the operator's position along the inclined flight. The invention also provides an improved method of operating such an exercise device.

MODIFICATIONS

The present invention contemplates that many changes and modifications may be made. For example, the shape and configuration of the various parts and components may be readily changed or modified to suit varied applications. Similarly, the endless members need not necessarily be chains. Indeed, they may be belts, tracks, or the like. Other means or mechanisms to couple the position of the operator to the resistance device may be readily substituted for the belt-and-cord connection shown in the preferred embodiment.

Therefore, while the presently preferred embodiment of the invention has been shown and described, and several modifications and changes thereof discussed, persons skilled in this art will readily appreciate that various additional changes and modifications may be made without departing from the spirit of the invention, as defined and differentiated by the following claims.

What is claimed is:

1. An exercise device to enable a person to simulate the climbing of a ladder by presentment of an endless series of rungs while remaining in a substantially fixed spatial position, comprising:

a frame;

a pair of transversely-spaced endless members journalled on said frame, said members having parallel flight portions;

a plurality of rungs having their opposite marginal end portions mounted on said respective members at longitudinally-spaced locations therealong;

resistance means for providing a variable resistance to free movement of said members; and control means including a cord attached to said person and operatively arranged to vary the resistance provided by said resistance means as a function of the position of a person relative to said flight portions.

2. An exercise device as set forth in claim 1 wherein said resistance means is a fan, and wherein the resistance of said fan is controlled as a function of the flow of air therethrough.

3. An exercise device as set forth in claim 2 wherein said fan is configured to have a squirrel cage rotor.

4. An exercise device as set forth in claim 1 wherein said flight portions are inclined at an acute included angle with respect to the vertical.

5. An exercise device as set forth in claim 4 wherein said acute included angle is from about 30° to about 60°.

6. In an exercise device adapted to enable a person to simulate the climbing of a ladder, said device having a plurality of rungs adapted to move relative to a person while that person remains generally in the spatial location, and wherein said device has a moving flight portion which said person attempts to climb, and wherein said device has a resistance device arranged to impede the free movement of said rungs along said flight portions, the improvement which comprises:

control means including a cord attached to said person for varying the resistance afforded by said resistance device as a function of the position of said person relative to said flight portions;

whereby, by varying his position relative to said flight portions, said person may vary the resistance afforded by said resistance device.

7. The improvement as set forth in claim 6 wherein said resistance device is a fan, and wherein said control means is arranged to vary the flow of air through said fan.

8. The improvement as set forth in claim 7 wherein the flow of air through said fan is controlled by varying the size of an aperture.

9. The method of operating an exercise device to enable a person to simulate the climbing of a ladder by presentment of an endless series of rungs, while remaining in a substantially constant spatial location, comprising the steps of:

providing a frame;

moving a plurality of spaced rungs in an endless series along said frame in a flight toward a person;

moving along said rungs of said flight to simulate a climbing motion while remaining in substantially the same spatial location;

moving relative to said frame along said flight;

providing control means having a cord attached to the person for operatively varying the resistance of said moving rungs; and varying the resistance of said moving rungs to such climbing motion as a function of the position of said person relative to said frame;

thereby to vary the resistance of said device to said climbing motion by varying the position of said person relative to said frame.

10. The method as set forth in claim 9 wherein the resistance of said moving rungs to such climbing motion is varied by selectively varying the flow of air through a fan.

* * * * *